United States Patent [19]

Wallace

[11] 4,430,926

[45] Feb. 14, 1984

[54] HYDRAULIC ROTARY-PERCUSSIVE MACHINES

[75] Inventor: Trevor E. Wallace, Sandton, South Africa

[73] Assignee: The Steel Engineering Company Limited, Roodepoort, South Africa

[21] Appl. No.: 3,770

[22] Filed: Jan. 11, 1979

Related U.S. Application Data

[63] Continuation of Ser. No. 804,155, Jun. 6, 1977, abandoned.

[30] Foreign Application Priority Data

Jun. 4, 1976 [ZA] South Africa ..... 76/3344

[51] Int. Cl.[3] ..... F15B 11/00

[52] U.S. Cl. ..... 91/516; 91/517; 173/105

[58] Field of Search ..... 91/31, 447, 516, 517, 91/518, 532; 173/105; 137/101, 110

[56] References Cited

U.S. PATENT DOCUMENTS

| | | | |
|---|---|---|---|
| 3,568,868 | 3/1971 | Chichester | 91/516 |
| 3,703,186 | 11/1972 | Brewer | 91/516 |
| 3,741,315 | 6/1973 | Hilton | 173/105 |
| 3,760,688 | 9/1973 | Dummer | 91/517 |
| 3,835,751 | 9/1974 | Cowan | 91/447 |
| 4,005,636 | 2/1977 | Dunn | 91/516 |
| 4,006,783 | 2/1977 | Granholm | 91/517 |

FOREIGN PATENT DOCUMENTS

| | | | |
|---|---|---|---|
| 1051125 | 2/1959 | Fed. Rep. of Germany | 91/516 |

*Primary Examiner*—Abraham Hershkovitz
*Attorney, Agent, or Firm*—Young & Thompson

[57] ABSTRACT

A single hydraulic supply line feeds fluid under pressure to a hydraulic percussive machine with a percussion motor and a rotation motor. The feed passes through two valves of the constant volume priority flow dividing type. The first valve gives priority to the percussion motor to the extent of establishing idling speed. The second valve in the bypass of the first valve gives priority to the rotation motor while its bypass reaches the percussion motor. Working speed of the percussion motor can only be obtained after the rotation motor is up to speed and control of the feed above the priorities controls the percussion motor speed only.

1 Claim, 3 Drawing Figures

HYDRAULIC ROTARY-PERCUSSIVE MACHINES

This is a continuation of application Ser. No. 804,155, filed June 6, 1977, now abandoned.

BACKGROUND OF THE INVENTION

This invention relates to hydraulic rotary percussive machines of the kind used for rock drilling.

In such machines there is a percussion motor to impart percussive energy to a rock drill stem and means to rotate the drill stem chucked to the machine. In some machines the piston of the motor causes rotation through a ratchet mechanism and in that case a single hydraulic feed line and a single tank line are required. In other machines the rotation is achieved by means of a motor (which can take many forms) which rotates the chuck independently of the percussion motor.

With an independent rotation motor it is also customary to have an independent source of hydraulic fluid, e.g. by having a prime mover driving two pumps: one for the percussion motor and one for the rotation motor. This is done so that the rotation motor is not starved of motive power by the percussion motor. The duplication of pumps and the need for extra supply and return lines makes this a cumbersome and expensive arrangement.

SUMMARY OF THE INVENTION

According to the invention a hydraulic percussive machine comprising a percussion motor and a rotation motor and means to feed them from a common source of fluid under pressure, has the improvement that the feeding means feeds flow regulating means establishing priority of flow to the rotation motor and bypass flow to the percussion motor after a predetermined constant flow to the rotation motor has been established.

Further according to the invention the machine includes a restrictive orifice (which may itself be a flow regulating means) between the feeding means and the flow regulating means which allows a constant minimum flow to the percussion motor to ensure that the percussion motor achieves a predetermined idling speed before the rotation motor receives priority.

In the result by controlling the flow of fluid to the machine above the level of priorities one can control the percussion motor without affecting the rotation motor in any way. It is thus possible to control the machine with greater sensitivity than is possible with a machine where rotation is effected by the reciprocation of the piston. Piston speed can be varied without varying the speed of rotation.

DESCRIPTION OF THE PREFERRED EMBODIMENTS

Figure 1:
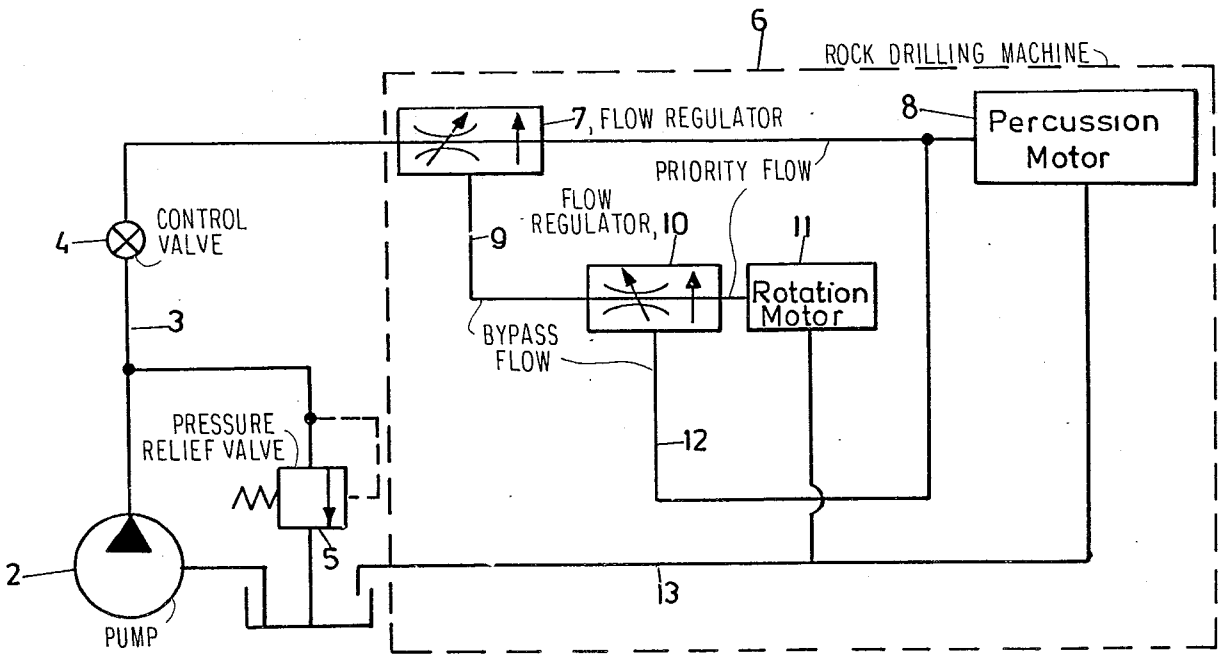
FIG. 1 is a hydraulic circuit diagram illustrating one embodiment of the invention.

In the diagram of FIG. 1 there is a pump 2 which feeds a supply line 3 with a control valve 4. A pressure relief valve 5 is also provided. The supply line 3 leads to a rock drilling machine which has been indicated diagrammatically as a dotted rectangle 6.

The supply line 3 first leads to a flow regulator 7 of the kind which is a combination bypass and restrictive orifice which establishes priority flow to a regulated circuit and a bypass flow to a secondary circuit only after the regulated circuit is satisfied. In this case the valve 7 establishes priority of flow to a percussion motor 8 and a bypass along a conduit 9 which feeds a valve 10 similar to the valve 7. The valve 10 establishes priority to the rotation motor 11 and a bypass along the conduit 12 to the percussion motor 8. A return line 13 leads from the motors 8 and 11 to tank.

In practice the valve 7 is so chosen that a minimum volume of hydraulic fluid reaches the motor 8 from it so that the motor 8 can idle at a predetermined speed. The valve 10 is so chosen that the rotation motor is fed with the volume of fluid required to cause it to rotate during all expected operating conditions.

The valve 4 is operated to control the machine. Once the motor 8 idles and the motor 11 rotates, control by the valve 4 controls the flow of fluid through conduit 12.

In a suitable case the valve 7 may be omitted so that the line 3 feeds directly into the valve 10. In this case idling speed, if required, has to be established by the valve 4.

Valves suitable for use as the valves 7 and 10 of the above described embodiment are commercially available. For example Gresen manufacturing company sell a model CFD-50 constant volume priority type flow divider, while Fluid Controls Inc. sell flow regulators of the same type to maintain a constant flow to a circuit when pump output varies or is greater than required for the regulated circuits. In a practical machine according to the invention valves of the known type would be housed in suitable bores and counterbores in the drilling machine casing in the same way as spindle valves for the control of reciprocation are so mounted.

The lines 3 and 13 may be co-axial so that a single hose to the machine 6 will suffice.

Figure 2:
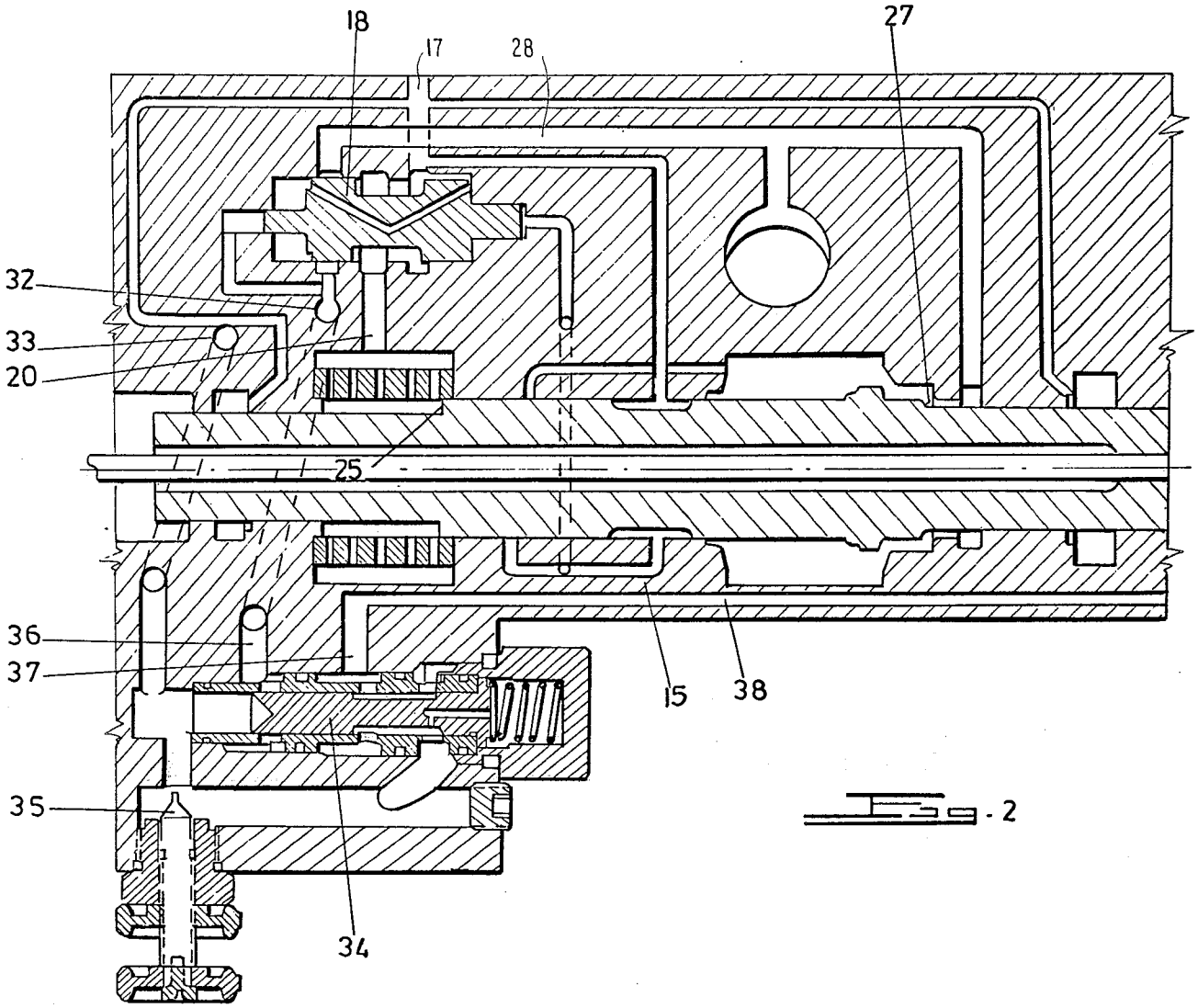
FIG. 2 is a section through a portion of a rock drilling machine.
Figure 3:
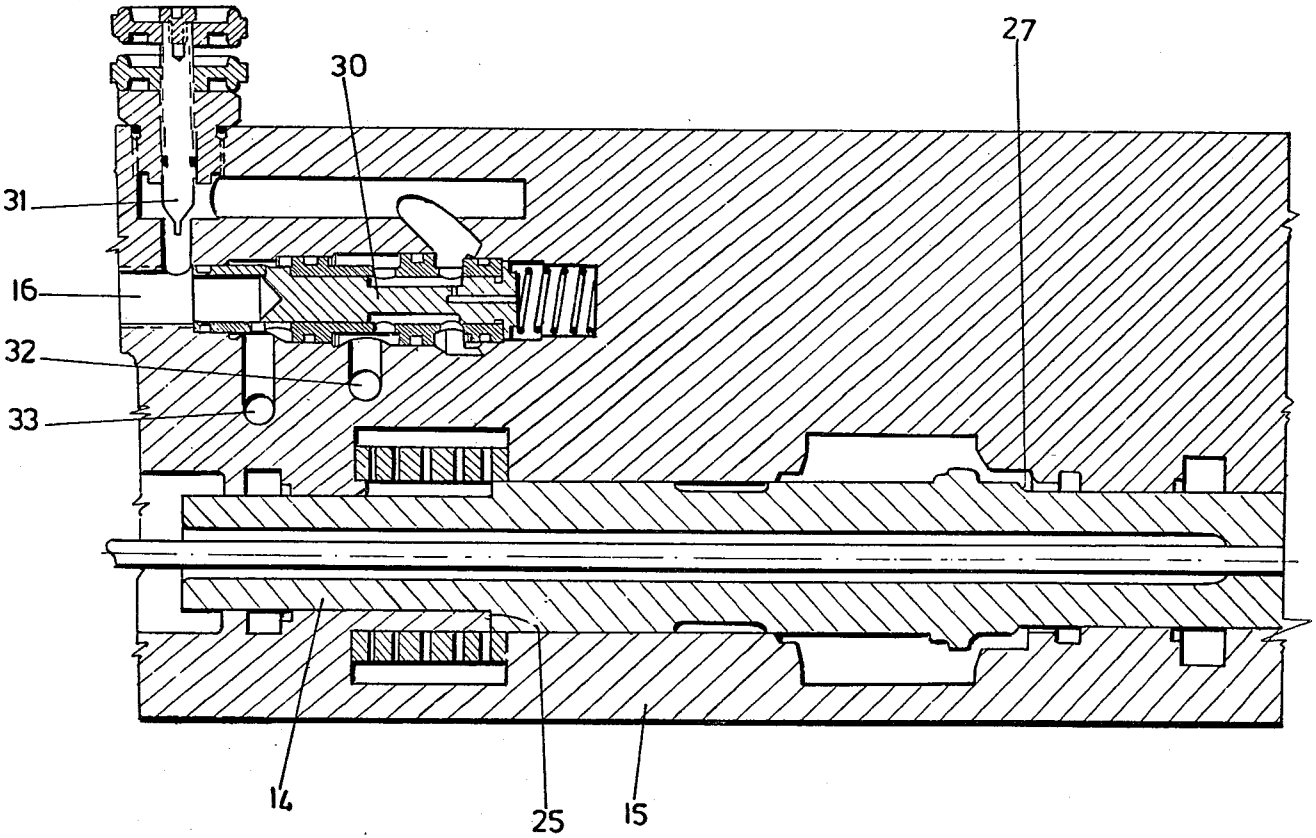
FIG. 3 is a section at an angle, say 90°, to the section of FIG. 1.

FIGS. 2 and 3 illustrate a rock drilling machine incorporating valves called "Flow Regulators" manufactured by Fluid Controls Inc.

The machine has a piston 14 working in a cylinder 15, and an outlet 17. There is also a valve 18 to control the action of the machine. Briefly an annular area formed by a shoulder 25 at the back end of the piston 14 acts as the effective working stroke area and an annular area formed by a shoulder 27 acts as the effective up-stroke working area. Other protruberances on the piston 14 serve functions which are not relevant to the present invention, but are fully explained in South African patent specification No. 76/1650. The annular area 25 is larger than the area 27 so that when they are exposed to equal pressures the piston 14 moves to the right. When the space behind the area 25 is vented to tank via the outlet 17, the piston 14 moves to the left and at the same time an accummulator gets charged.

The right hand end of the machine is fitted with a chuck (not shown) to take a drilling tool and a suitable hydraulic motor (not shown) to rotate the chuck. This is standard and common practice in hydraulic percussive machines.

Attached to this known machine are two flow regulators. The inlet 16 leads to the first one of these which has a spool 30, a control needle 31, a regulated port 32 and a bypass port 33. The regulated port leads to the valve 18 and also to a passage 28 via an annular space around the valve 18. The bypass port 33 leads to the second flow regulator having a spool 34 and a regulating needle 35. The latter flow control valve has a bypass port 36 which communicates with the port 32 and a regulated port 37 leadng into a longitudical duct 38 which feeds the motor (not shown) for rotating the chuck.

The needle 31 is set to allow enough fluid to reach the port 32 to allow the piston 14 to reciprocate at idling speed. The needle 35 is set to allow fluid to reach the rotation motor so that it rotates under all expected conditions. Thus only if the piston idles, does the motor commence to rotate, and only if the motor rotates properly will there be fluid available to cause the piston 14 to work above idling speed and at working speed. In each case there is regulated flow to the regulated port regardless of the pressure in the system.

I claim:

1. A hydraulic rotary percussive machine comprising a percussion motor, a rotation motor, a feed line to the machine from a source of fluid under pressure, a control valve in the feed line, a return line from the machine, and downstream of the control valve first flow regulating means, a first passage leading from the first flow regulating means to the rotation motor, a second passage leading from the first flow regulating means to the percussion motor, the first flow regulating means establishing priority of flow to the first passage and bypass flow to the second passage only after a predetermined constant flow to the first passage has been established, operation of the control valve establishing, controlling and interrupting flow to the first flow regulating means, a restrictive orifice between the control valve and the first flow regulating means leading to the second passage to ensure that the percussive motor achieves a predetermined idling speed before the rotation motor receives priority, the restrictive orifice being a second flow regulating means which establishes priority flow to the percussion motor.

* * * * *